United States Patent [19]

Ricci et al.

[11] Patent Number: 4,996,400

[45] Date of Patent: Feb. 26, 1991

[54] SELF ADJUSTING SWITCH

[75] Inventors: Richard J. Ricci; Wallace E. Gebhardt, both of Logansport, Ind.

[73] Assignee: Federal-Mogul Corporation, Southfield, Mich.

[21] Appl. No.: 425,545

[22] Filed: Oct. 23, 1989

[51] Int. Cl.[5] ..... H01H 13/02

[52] U.S. Cl. ..... 200/345; 200/531; 200/318; 200/327

[58] Field of Search ..... 200/345, 43.01, 43.16, 200/43.19, 520, 530, 531, 61.7, 61.89, 318, 318.1, 344, 321, 327, 302.2

[56] References Cited

U.S. PATENT DOCUMENTS

| | | | |
|---|---|---|---|
| 963,301 | 7/1910 | Leppert | 200/531 |
| 1,638,905 | 8/1927 | Aalborg | 200/318.1 |
| 2,454,342 | 11/1948 | Ross | 200/345 |
| 3,249,727 | 5/1966 | Furman | 200/530 |
| 3,251,971 | 5/1966 | Fraser | 200/530 |
| 3,869,591 | 3/1975 | Piber | 200/321 |
| 3,953,696 | 4/1976 | Reimann et al. | 200/318.1 |
| 4,025,748 | 5/1977 | Filip | 200/321 |
| 4,044,215 | 8/1977 | Leibinger et al. | 200/321 |
| 4,137,440 | 1/1979 | Bryant | 200/61.89 |
| 4,181,826 | 1/1980 | Letasiewicz | 200/344 |

FOREIGN PATENT DOCUMENTS

| | | | |
|---|---|---|---|
| 3439695 | 5/1986 | Fed. Rep. of Germany | 200/345 |

*Primary Examiner*—Henry J. Recla
*Assistant Examiner*—Glenn T. Barrett
*Attorney, Agent, or Firm*—Lawrence J. Shurupoff

[57] ABSTRACT

A switch plunger is covered at its exposed end with a serrated cap which is ratchetable over the end of the plunger. The plunger is axially slidable within a housing upon which is mounted a selectively operable locking pin. The locking pin may be actuated during installation of the switch so as to fix the relative position of the plunger within the housing during installation. This initial setting of the plunger within the housing also aligns a pair of electrical contacts mounted on the plunger with cooperating circuitry mounted within the housing. The switch is initially installed and calibrated simply by engaging the lock pin with the plunger and inserting the switch within an aperature formed in a cover or housing and abutting the cap with a switch actuator.

5 Claims, 3 Drawing Sheets

14
16
20
24
30
52
54
48
50

58
62
56
12
22
38
46
40
44
42
10
98

SELF ADJUSTING SWITCH

BACKGROUND OF THE INVENTION

1. Field of the Invention

This invention relates generally to electrical switches and particularly relates to a linear motion switch which is automatically adjusted upon installation.

2. Discussion of Prior Developments

Self adjusting switches have been in use for many years. Switches of this type are frequently used in applications where large tolerances tend to stack up or accumulate between parts thereby requiring an adjustment, setting or calibration of the switch before it may be placed in normal operation. An example of such a switch is shown in U.S. Pat. No. 3,249,727 wherein a switch plunger assembly provides for a frictionally retained telescoping adjustment extending between the frame and door of an automobile. While this type of switch serves its purpose well, it requires the actuation or closing of the car door to effect the setting of the plunger length.

In some applications it is desirable to be able to calibrate or set the length or stroke of a switch actuator without requiring actuation or movement of the components, devices or mechanisms which actuate the switch in normal use. For example, it is often desirable to install hydraulically or pneumatically actuated devices or subsystems as self-contained preset and pre-adjusted units. If such a hydraulic unit requires a sensor or switch which must be set or calibrated before use, it is most inconvenient, time consuming and potentially messy to fill the system with fluid, mount it for actuation and actuate it just to adjust or set the sensor or switch.

Accordingly, a need exists for a switch which is self adjusting and self calibrating upon its installation and which does not require actuation of the component or device which typically actuates the switch during normal use.

SUMMARY OF THE INVENTION

The present invention has been developed to fulfill the needs noted above and therefore has as a primary object the provision of a switch which is self adjusting yet which does not require actuation of the system or mechanism which typically actuates the switch during normal switch operation.

Briefly, the invention includes a switch plunger fitted with an axially telescoping ratcheted end cap for engagement with a locating or calibrating surface of a switch actuator which, during normal use, actuates the switch plunger. A selectively engageable lock pin serves as an axial stop or abutment which axially locates the plunger with respect to the switch body and switch contacts during mounting of the switch to a mounting surface. As the entire switch assembly is initially installed, the end cap on the plunger engages an actuator surface and axially ratchets and slides over the plunger with a telescoping movement. The lock pin prevents the plunger from moving axially during this portion of installation and further establishes a datum or reference point from which the switch contacts, which are connected to the plunger and to the switch housing, are located and set.

Once installed, the lock pin is disengaged from the plunger thereby allowing the plunger to travel freely during normal use. Thus during installation, all calibration and adjustment of the switch is independent of any actuation of the device which actuates the switch.

One particularly useful application of such a switch is for engaging a bellows or movable member within a brake booster for providing a signal required to control an anti skid or anti brake lock mechanism. In this application both hydraulic and pneumatic devices are involved. Accordingly, the present invention can be used particularly advantageously in this case as the switch may be calibrated without requiring hydraulic or pneumatic power and without requiring actuation of the brake.

BRIEF DESCRIPTION OF THE DRAWINGS

Various other objects, features and attendent advantages of the present invention will be more fully appreciated from the following detailed description when considered in connection with the accompanying drawings, in which the same reference numbers designate the same or corresponding parts throughout.

DETAILED DESCRIPTION OF THE PREFERRED EMBODIMENT

Figure 7:
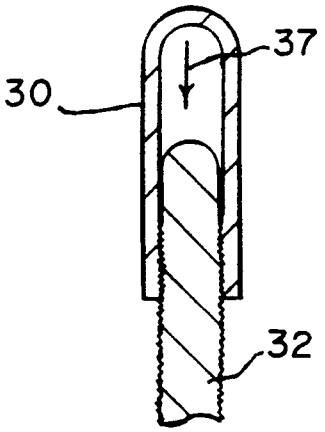
FIG. 7 is a fragmental enlarged view of the plunger and end cap.

The present invention will now be described in conjunction with the drawings beginning with FIGS. 1 and 2, which show one form of the invention suitable for use as a position sensor for an anti-lock brake mechanism such as found on current model automobiles. Switch or sensor 10 includes a molded plastic housing 12 having a cover plate 14 secured at one end such as with epoxy 15 or the like. The cover plate 14 is formed with an arcuate recess 16 for receiving the curved end 18 of a guide rod 20. Recess 16 and curved end 18 form a partial ball and socket type joint which provides for self-alignment of the guide rod within the switch housing.

A hollow plunger 22 is slidably fitted over the guide rod and is biased axially outwardly from the housing by a biasing member such as by compression coil spring 24. A radial flange 26 is formed at the base of plunger 22 for engaging spring 24. Another radial flange 28 is provided adjacent end 18 of the guide rod for seating and anchoring spring 24 thereon.

A tubular adjusting cap 30 is fitted over the outwardly projecting end portion 32 of plunger 22. The inner walls of cap 30 are serrated or grooved at 34 as is the outer surface of plunger end portion 32, i.e. at 36. The serrations are formed to allow cap 30 to ratchet over plunger end portion 32 toward the housing 12 as represented by arrow 37 in FIG. 7, but to prevent movement of the cap in the opposite direction. The serrations 34, 36 provide sufficient support between the cap and the plunger to allow the cap to transmit sufficient axial force to fully compress spring 24 without moving the cap over the plunger serrations during normal operation of the switch.

Figures 3, 4:
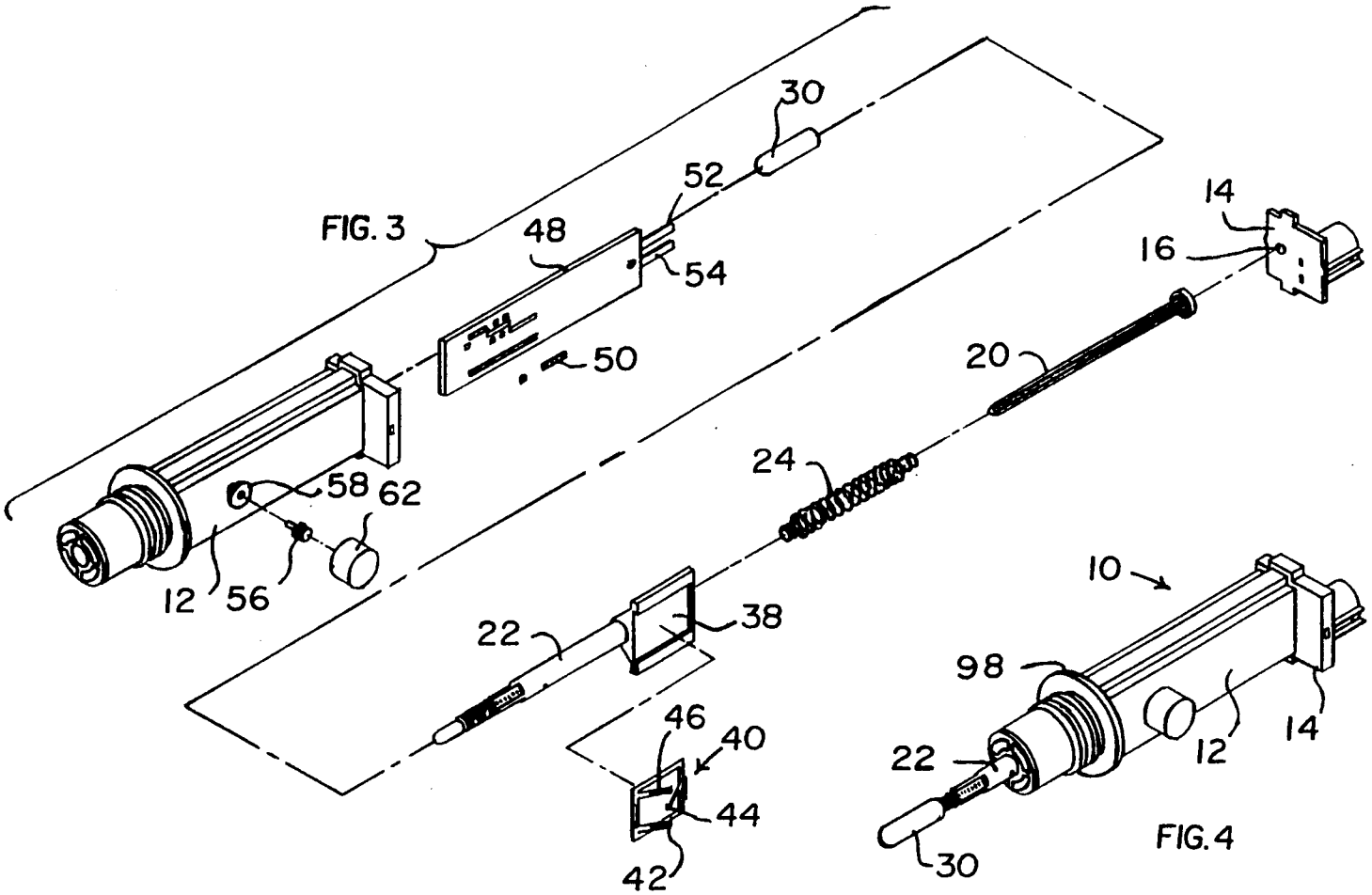
FIG. 3 is a perspective exploded view of the switch of FIG. 1.
FIG. 4 is a perspective view of the switch of FIG. 1.

As seen in FIG. 3, the plunger 22 is formed with a mounting surface 38 formed of an electrical insulator such as plastic for receiving electric switch contact member 40. Contact member 40 is formed of a metallic material and may be snap fitted to mounting surface 38 in a known fashion. Electric contact arms 42, 44, 46 are formed as cantelevered leaf springs which slide along and make biased contact with an adjacent switch terminal. As shown in the drawings, this adjacent contact terminal takes the form of a circuit board 48 which is fitted with axially spaced chip resistors 50.

The central contact arm 44 maintains contact with a ground circuit while the side electric contact arms 42, 46 make alternating contact with the axially spaced and axially staggered chip resistors as the plunger is moved axially. As the different chip resistors alternately complete electric circuits through contact arms 42, 44 then through contact arms 42, 46, a variable electric signal is provided through electric leads 52, 54 which are connected to the chip resistors and to a signal receiving device such as a microprocessor or other electrical or electronic device. This signal may correspond to the axial location of plunger 22 which in turn corresponds to the position of an actuating member which is in engagement with cap 30. Thus, the switch functions as a variable resistor. However, a simple make and break contact may be used, or any other type of switch contacts or circuitry may be used.

Figure 8:
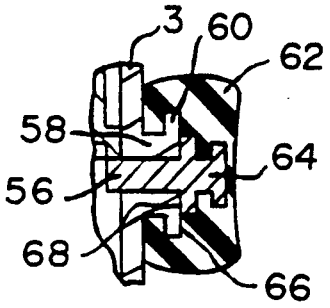
FIG. 8 is a fragmental enlarged view of the grommet and lock pin in the position as shown in FIG. 1.
Figure 1:
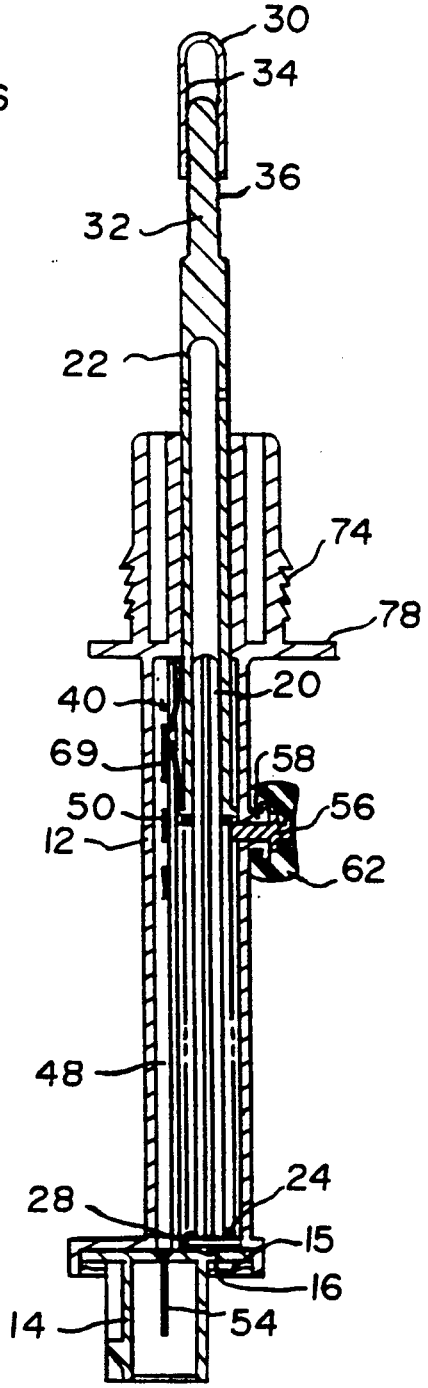
FIG. 1 is an axial sectional view of a switch constructed in accordance with the present invention, showing the switch and lock pin in a position set for installation.

As shown in FIGS. 1 and 8, a lock pin 56 is slidably mounted within a boss 58 formed on housing 3. Boss 58 is formed with a cylindrical port for receiving the lock pin and is also formed with an axial flange 60. Flange 60 is dimensioned to engage and snugly fit within a recess formed in an elastomeric button 62. Button 62 is formed with an additional recess or recesses for receiving and retaining the head 64 of lock pin 56.

Figure 2:
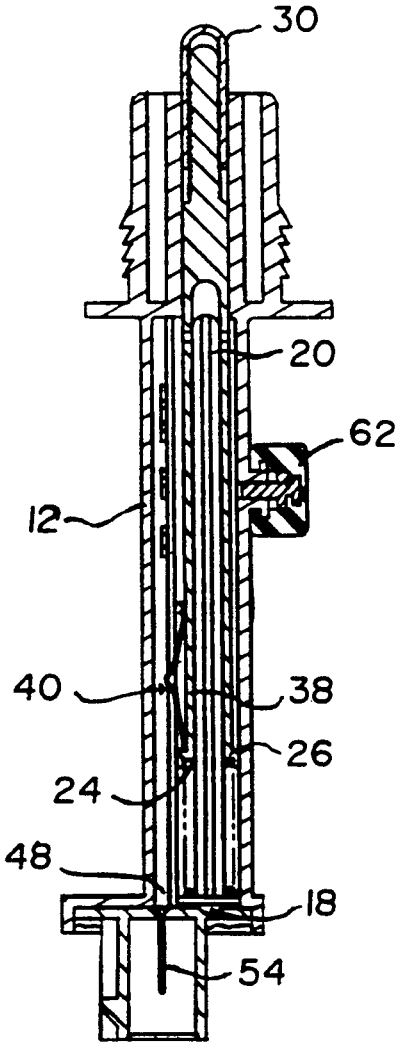
FIG. 2 is an axial sectional view of the switch of FIG. 1, shown in a fully actuated and adjusted position.

As best seen in FIG. 2, when button 62 is in its free or uncompressed position, it maintains the lock pin 56 out of engagement with plunger 22. However if the button is depressed toward the housing 12, the lock pin 56 will slide through the boss and project radially within the housing 12 for engaging the bottom surface of the plunger 22. Because the button is elastic, it will retract the lock pin upon its release and return to its uncompressed position. The extent of travel of lock pin 56 is set by the dimensioning between the top outer surface 66 of boss 58 and the bottom surface 68 of lock pin head 64 (FIG. 8).

The axial spacing and location of boss 58 and lock pin 56 is carefully set with respect to the axial location of the electric contact arms 42, 44, 46 when lock pin 56 is in engagement with the bottom of the plunger 22 as shown in FIG. 1. Moreover, the axial location and spacing of the electric contact or contacts on circuit board 48 is also carefully set with respect to lock pin 56. With these axial spacings being predetermined, a simple and easy calibration or presetting of switch 10 is made possible. As shown in FIG. 1, contact of the switch is initially set between resistor 69 and one pair of the contact arms 42, 44.

Figure 5:
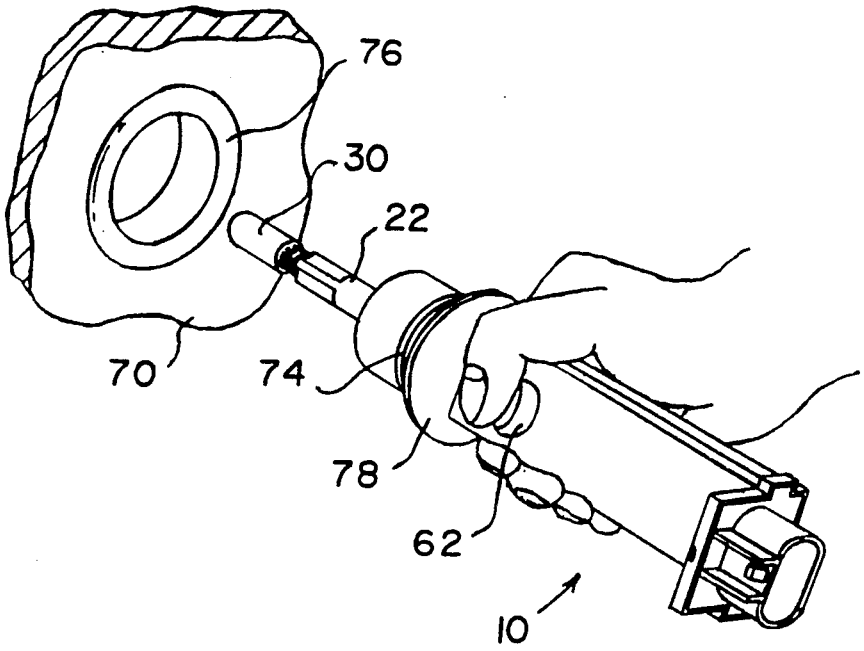
FIGS. 5 and 6 are perspective views showing an installer installing the switch of FIG. 1 in a typical application.
Figure 6:
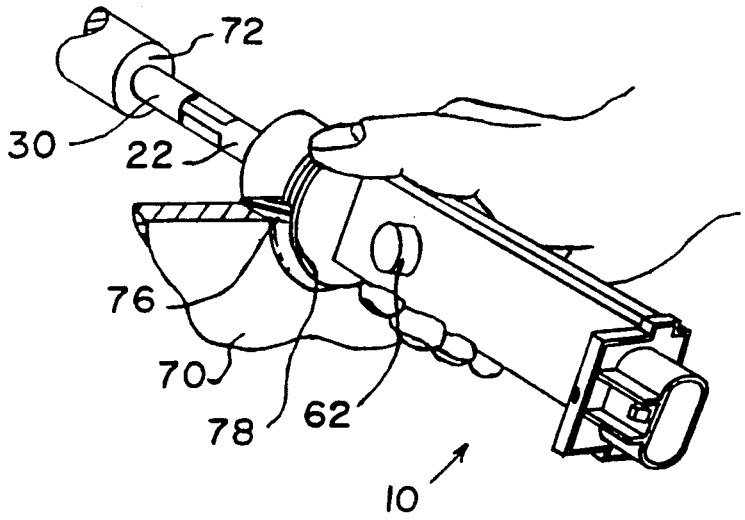

As seen in FIGS. 4, 5 and 6 an installer will initially compress button 62 to extend lock pin 56 into the interior of housing 12 such as shown in FIG. 1. The installer will then mount the switch with an axially forced movement within a wall or cover 70 of an actuator 72, such as a diaphragm or movable member on a brake booster mechanism or other device. Preferably, the actuator 72 is at this time in an inoperative or "at rest" position so that it need not be actuated to set the initial position of the switch. Typically, there will exist significant tolerances between actuator 72 and wall 70 thereby requiring the subject calibration. Housing 12 may be formed with mounting teeth 74 for anchoring the switch 10 to a grommet 76 mounted in the cover 70.

As cap 30 engages the switch actuator 72, the cap pushes plunger 22 into engagement with the lock pin 56. Continued axial force applied by the installer causes cap 30 to telescopically slide over the top portion of the plunger until flange 78 on housing 12 abuts wall 70. At this point the installer releases pressure on the button to disengage the lock pin from the plunger and installation and calibration is then complete.

One application of the switch is for sensing brake pedal travel by sensing the location of a diaphragm in a brake booster. In this application the interior of cover 70 will be exposed to vacuum. By using the design discussed above, a virtually air tight seal may be formed between the teeth 74, and grommet 76 and between button 62 and housing 12. Thus, button 62 also functions as a seal which tightly seals around the edges of flange 60 with a tight compressive fit.

Obviously numerous modifications and variations of the present invention are possible in light of the above teachings. It is therefore to be understood that within the scope of the appended claims, the invention may be practiced otherwise than as specifically described herein.

What is claimed is:

1. A self adjusting switch having a stroke length which is adjusted and set automatically during installation, comprising:

a housing, a plunger slidably fitted within said housing, installation engagement means provided on said housing for selectively engaging said plunger and preventing axial movement of said plunger with respect to said housing during installation of said switch, an adjustable cap fitted on an end portion of said plunger, said cap being axially adjustable in a single direction upon selective engagement of said engagement means with said plunger so as to adjust and set said stroke length; and switch contact means operatively associated with said plunger.

2. The switch of claim 1, wherein said switch contact means comprises electrical contact means mounted on said plunger and electrical contact means mounted on said housing.

3. The switch of claim 2, wherein said electrical contact means mounted on said plunger comprises resilient contact arms and wherein said electrical contact means mounted on said housing comprises variable resistance means.

4. The switch of claim 1, wherein said engagement means comprises a lock pin normally biased out of engagement with said plunger.

5. The switch of claim 4, further comprising an elastomeric button connected to said lock pin for biasing said lock pin out of said engagement with said plunger.

* * * * *